US009748696B2

(12) United States Patent
Nishimura et al.

(10) Patent No.: US 9,748,696 B2
(45) Date of Patent: Aug. 29, 2017

(54) ACTIVE CABLE

(71) Applicant: Hitachi Metals, Ltd., Tokyo (JP)

(72) Inventors: Kei Nishimura, Hitachi (JP); Izumi Fukasaku, Hitachi (JP); Takahiro Sugiyama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/736,087

(22) Filed: Jun. 10, 2015

(65) Prior Publication Data

US 2016/0006181 A1 Jan. 7, 2016

(30) Foreign Application Priority Data

Jul. 1, 2014 (JP) ..... 2014-135991

(51) Int. Cl.
*H01B 11/00* (2006.01)
*H01R 13/6469* (2011.01)

(52) U.S. Cl.
CPC ..... *H01R 13/6469* (2013.01)

(58) Field of Classification Search
CPC .. H01B 11/00; H01B 11/20; H01L 2924/1079
USPC ..... 174/260
See application file for complete search history.

(56) References Cited

U.S. PATENT DOCUMENTS 5,999,796 A * 12/1999 Tresness ..... H03H 7/461 348/E7.07
2006/0089053 A1* 4/2006 Morlion ..... H01R 13/6658 439/660
2008/0266019 A1* 10/2008 Fusayasu ..... H04B 3/34 333/12
2011/0100694 A1* 5/2011 Regnier ..... H01R 13/6658 174/260
2014/0359177 A1* 12/2014 Florentino ..... G06F 13/387 710/104
2015/0295298 A1* 10/2015 Payne ..... H01P 3/16 343/837

FOREIGN PATENT DOCUMENTS

JP 2013-122825 A 6/2013

* cited by examiner

*Primary Examiner* — Hoa C Nguyen
*Assistant Examiner* — Stanley Tso
(74) *Attorney, Agent, or Firm* — McGinn IP Law Group, PLLC

(57) ABSTRACT

An active cable that is capable of reducing crosstalk is provided. A ground pattern is formed so as to sandwich one or both of a part of a transmission side transmission channel located at a side closer to the other side than a compensation circuit and a part of a reception side transmission channel located at a side closer to the other side than the compensation circuit.

10 Claims, 4 Drawing Sheets

ACTIVE CABLE

The present application is based on Japanese patent application No. 2014-135991 filed on Jul. 1, 2014, the entire contents of which are incorporated herein by reference.

BACKGROUND OF THE INVENTION

1. Field of the Invention

The present invention relates to an active cable.

2. Description of the Related Art

A cable with a connector, the cable including a cable provided with a plurality of differential signal transmission cables that are built therein and a connector provided at each of both ends of the cable, is used.

A paddle card that electrically connects a connection target device and the differential signal transmission cables to one another is built in the connector. A cable including a compensation circuit that actively compensates an electric signal in accordance with a loss property of the differential signal transmission cables and outputs the compensated electric signal to a transmission channel at a reception side in the paddle card, that is, a transmission channel through which an electric signal input from the differential signal transmission cable to the device, is also referred to as an active cable (an active direct-attach cable, an active DAC, or an active copper cable (ACC)).

As illustrated in FIGS. 4A and 4B, a known active cable 41 includes a cable 43 provided with a plurality of differential signal transmission cables 42, a connector 44 provided at each of both ends of the cable 43, and a paddle card 45 that is built in the connector 44 and electrically connects a connection target device (not illustrated) and the differential signal transmission cables 42 to one another. The active cable 41 is configured so as to be capable of performing single-channel transmission and reception, and includes one differential signal transmission cable 42 for each of transmission and reception, that is, two differential signal transmission cables 42 in total.

A plurality of transmission side electrodes 46 and a plurality of reception side electrodes 47, which are electrically connected to the device, are formed at one end portion of the paddle card 45. Also, a plurality of for-cable-connection transmission side electrodes 48 to which the differential signal transmission cables 42 for transmission are electrically connected and a plurality of for-cable-connection reception side electrodes 49 to which the differential signal transmission cables 42 for reception are connected are formed in the other end portion of the paddle card 45.

The transmission side electrodes 46 and the for-cable-connection transmission side electrodes 48 corresponding thereto are electrically connected to one another via a transmission side transmission channel 50. The reception side electrodes 47 and the for-cable-connection reception side electrodes 49 corresponding thereto are electrically connected to one another via a reception side transmission channel 51. A compensation circuit 52 that actively compensates an electric signal in accordance with a loss property of the differential signal transmission cables 42 and outputs the compensated electric signal is provided in the reception side transmission channel 51.

Ground layers 53 that are shared by a transmission side and a reception side are formed in an inner layer and a back layer (other layers than layers in which the transmission channels 50 and 51 are formed) of the paddle card 45.

In the known active cable 41, each of the transmission side transmission channel 50 and the reception side transmission channel 51 has a microstrip structure, and both of the transmission side transmission channel 50 and the reception side transmission channel 51 are formed in the same layer (a surface layer of the paddle card 45).

Note that, as relevant art document information related to the present invention, there is Japanese Unexamined Patent Application Publication No. 2013-122825.

SUMMARY OF THE INVENTION

In general, however, in an active cable, in particular, when long distance transmission is performed using a long cable, a difference in signal level between a transmission side and a reception side is increased, and the active cable is more likely to be influenced by near-end crosstalk caused by a common mode.

In the known active cable 41, the transmission side transmission channel 50 and the reception side transmission channel 51 are formed in the same layer, and therefore, a problem arises in which, in particular, crosstalk tends to be increased due to connection between lines.

It is therefore an object of the present invention to solve the above-described problem and provide an active cable which is capable of reducing crosstalk.

According to one exemplary aspect of the invention, an active cable includes a cable provided with a plurality of differential signal transmission cables, a connector provided at each of both ends of the cable, a paddle card formed of a multilayer substrate which is built in the connector and is configured such that an electrode electrically connected to a connection target device is formed at one end thereof and the differential signal transmission cables are electrically connected to the other end thereof to electrically connect the device and the differential signal transmission cables to one another, a transmission side transmission channel formed in the paddle card and configured to transmit an electric signal input from the device to the differential signal transmission cables, a reception side transmission channel formed in the paddle card and configured to transmit an electric signal input from the differential signal transmission cables to the device, and a compensation circuit provided in the reception side transmission channel and configured to compensate an electric signal input from the differential signal transmission cables in accordance with a loss property of the differential signal transmission cables and output the compensated electric signal, and in which a ground pattern is formed so as to sandwich one or both of a part of the transmission side transmission channel located at a side closer to the other end than the compensation circuit and a part of the reception side transmission channel located at a side closer to the other end than the compensation circuit.

In the above exemplary invention, the following exemplary modifications and changes can be made alone or in any combination thereof.

(i) The transmission side transmission channel and the reception side transmission channel may be formed in a surface layer of the paddle card, and the ground pattern may be formed so as to sandwich one or both of the part of the transmission side transmission channel located at a side closer to the other end than the compensation circuit and the part of the reception side transmission channel located at a side closer to the other end than the compensation circuit in a direction parallel to a surface of the paddle card, thereby providing a transmission channel having a coplanar structure.

(ii) One of the part of the transmission side transmission channel located at a side closer to the other end than the compensation circuit and the part of the reception side transmission channel located at a side closer to the other end than the compensation circuit may be formed in an inner layer of the paddle card via a via and the ground pattern may be formed so as to sandwich the transmission channel formed in the inner layer in a thickness direction of the paddle card, thereby providing a transmission channel having a strip structure.

(iii) The reception side transmission channel may be formed in the surface layer of the paddle card and the transmission side transmission channel may be formed in an inner layer of the paddle card, thereby providing a strip structure.

(iv) The paddle card may include a ground layer which is divided into a first ground layer corresponding to the transmission side transmission channel and a second ground layer corresponding to the reception side transmission channel.

According to the present invention, an active cable which is capable of reducing crosstalk can be provided.

BRIEF DESCRIPTION OF THE DRAWINGS

The foregoing and other exemplary purposes, aspects and advantages will be better understood from the following detailed description of the invention with reference to the drawings, in which:

FIG. 1A is a plan view, and FIG. 1B is a cross-sectional view taken along the line IB-IB.

FIG. 2A is a plan view, FIG. 2B is a cross-sectional view taken along the line IIB-IIB, and FIG. 2C is a cross-sectional view taken along the line IIC-IIC.

FIG. 4A is a plan view, and FIG. 4B is a cross-sectional view taken along the line IVB-IVB.

DESCRIPTION OF THE PREFERRED EMBODIMENTS

Figure 1A:
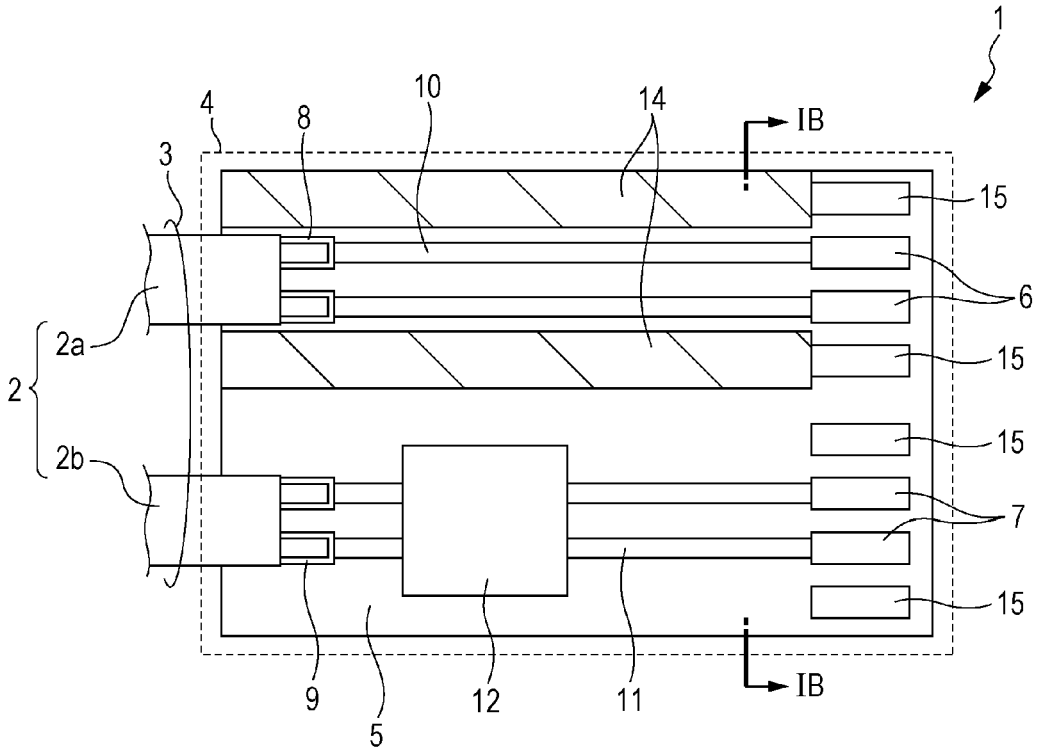
FIGS. 1A and 1B illustrate an active cable according to an embodiment of the present invention.

Referring now to the drawings, and more particularly to FIGS. 1A to 3, there are shown exemplary embodiments of the methods and structures according to the present invention.

Figure 1B:
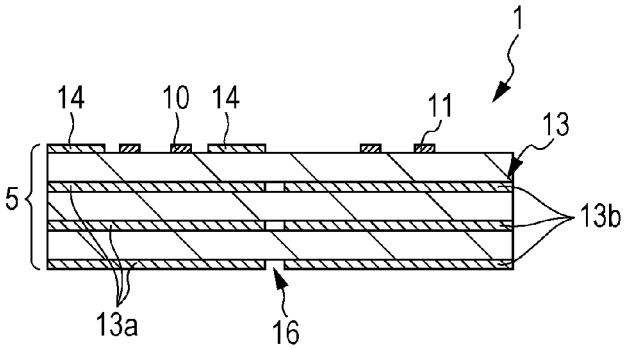

FIGS. 1A and 1B illustrate an active cable according to this embodiment, FIG. 1A is a plan view, and FIG. 1B is a cross-sectional view taken along the line IB-IB.

As illustrated in FIGS. 1A and 1B, an active cable 1 includes a cable 3 provided with a plurality of differential signal transmission cables 2, a connector 4 provided at each of both ends of the cable 3, and a paddle card 5 formed of a multilayer substrate which is built in the connector 4 and is configured such that electrodes 6 and 7 electrically connected to a connection target device (not illustrated) are formed at one end thereof and the differential signal transmission cables 2 are electrically connected to the other end thereof to electrically connect the device and the differential signal transmission cables 2 to one another.

In this embodiment, a case where the active cable 1 is configured such that single-channel transmission and reception is enabled will be described. In this case, the active cable 1 includes one differential signal transmission cable 2 for each of transmission and reception, that is, two differential signal transmission cables 2 in total.

A plurality of transmission side electrodes 6 and a plurality of reception side electrodes 7, which are electrically connected to the device, are formed in one end portion (an end portion at an opposite side to a connection side to which the cable 3 is connected) of a surface of the paddle card 5. In addition to the transmission side electrodes 6 and the reception side electrodes 7, a ground electrode 15, a for-power-supply electrode (not illustrated), a for-control-signal electrode (not illustrated), and the like, are formed in the one end portion of the surface of the paddle card 5 so as to align with one another, thereby forming a card edge connector.

A plurality of for-cable-connection transmission side electrodes 8 to which a differential signal transmission cable 2*a* for transmission is electrically connected and a plurality of for-cable-connection reception side electrodes 9 to which a differential signal transmission cable 2*b* for reception is electrically connected are formed in the other end portion (an end portion at the connection side to which of the cable 3 is connected) of the paddle card 5. Note that outputting an electric signal from the paddle card 5 to the differential signal transmission cables 2 is herein referred to as transmission, and inputting an electric signal from the differential signal transmission cables 2 to the paddle card 5 is herein referred to as reception.

Each of the transmission side electrodes 6 and a corresponding one of the for-cable-connection transmission side electrodes 8 are electrically connected to one another via a transmission side transmission channel 10. The transmission side transmission channel 10 is used in transmitting an electric signal input from the device via the transmission side electrodes 6 to the for-cable-connection transmission side electrodes 8 and then transmitting the electric signal to the differential signal transmission cable 2*a*, and is formed of a wiring pattern formed mainly on the paddle card 5.

Each of the reception side electrodes 7 and a corresponding one of the for-cable-connection reception side electrodes 9 are electrically connected to one another via a reception side transmission channel 11. The reception side transmission channel 11 is used in transmitting an electric signal input from the differential signal transmission cable 2*b* via the for-cable-connection reception side electrodes 9 to the reception side electrodes 7 and then transmitting the electric signal to the device, and is formed of a wiring pattern formed mainly on the paddle card 5.

A compensation circuit 12 that actively compensates an electric signal input from the differential signal transmission cable 2*b* in accordance with a loss property of the differential signal transmission cable 2*b* and outputs the compensated electric signal is provided on the reception side transmission channel 11.

In this embodiment, a four-layer substrate is used as the paddle card 5, the transmission side transmission channel 10 and the reception side transmission channel 11 are formed in a first layer (a surface layer), and a ground layer 13 is formed in each of second to fourth layers.

In this embodiment, each of the ground layers 13 formed in the second to fourth layers of the paddle card 5 is divided into a ground layer 13*a* (first ground layer) corresponding to the transmission side transmission channel 10 and a ground layer 13*b* (second ground layer) corresponding to the reception side transmission channel 11. A slit 16 is formed between the ground layer 13*a* and the ground layer 13*b* and the ground layers 13*a* and 13*b* are separated from one another by the slit 16. Reduction in crosstalk between transmission and reception is enabled by dividing the ground layer 13 between the transmission side and the reception side.

Since the transmission side transmission channel 10 and the reception side transmission channel 11 are formed at a left side and a right side of FIG. 1B, respectively, the ground layer 13 is divided at a center portion in a left-and-right direction, but a dividing position of the ground layer 13 and respective shapes of the ground layers 13*a* and 13*b* after being divided are not particularly limited and may be modified, as appropriate, in accordance with shapes of the transmission channels 10 and 11, and the like.

In the active cable 1 according to this embodiment, the ground pattern 14 is formed so as to sandwich a part of the transmission side transmission channel 10 located at a side (a differential signal transmission cable 2 side) closer to the other end than the compensation circuit 12.

In this embodiment, a case where the ground pattern 14 is formed so as to sandwich the entire transmission side transmission channel 10 is described, but the ground pattern 14 may be formed so as to sandwich at least the part of the transmission side transmission channel 10 located at a side closer to the other end than the compensation circuit 12. This is because, in particular, in long distance transmission, an electric signal at the reception side before being compensated by the compensation circuit 12 has a low signal level and is likely to be influenced by crosstalk from the transmission side.

In this embodiment, the ground pattern 14 is formed so as to sandwich the transmission side transmission channel 10 in a direction parallel to the surface of the paddle card 5, thereby providing a transmission channel having a coplanar structure. In this case, the transmission side transmission channel 10 is formed so as to extend linearly along a length direction (a left-and-right direction in FIG. 1A) of the paddle card 5, and therefore, the ground pattern 14 is formed at both sides of the transmission side transmission channel 10 in the length direction so as to extend along the transmission side transmission channel 10 and to sandwich the transmission side transmission channel 10 in a width direction (an up-and-down direction in FIG. 1A).

The ground pattern 14 is formed so as to extend from a ground electrode 15 to the other end of the paddle card 5 and to have a strip shape extending across substantially the entire paddle card 5.

By forming the ground pattern 14, leakage of electric field to the reception side may be reduced, and thus, reduction in crosstalk may be enabled.

Note that, although, in this embodiment, a case where the ground pattern 14 is formed so as to sandwich the transmission side transmission channel 10 has been described, the ground pattern 14 is not limited thereto, the ground pattern 14 may be formed so as to sandwich a part of the reception side transmission channel 11 located at a side closer to the other end than the compensation circuit 12, and the ground pattern 14 may be formed so as to sandwich each of both of a part of the transmission side transmission channel 10 located at a side closer to the other end than the compensation circuit 12 and a part of the reception side transmission channel 11 located at a side closer to the other end than the compensation circuit 12.

As has been described above, in the active cable 1 according to this embodiment, the ground pattern 14 is formed so as to sandwich one of the part of the transmission side transmission channel 10 located at the side (the differential signal transmission cable 2 side) closer to the other end than the compensation circuit 12 and the part of the reception side transmission channel 11 located at the side closer to the other end than the compensation circuit 12, or both of the parts.

Thus, in a region located at a side closer to the other end than the compensation circuit 12, which is a region that is likely to be influenced by crosstalk, at least one of the transmission side transmission channel 10 and the reception side transmission channel 11 is sandwiched by the ground pattern 14 and thus is shielded, so that leakage of electric field from the transmission side to the reception side may be reduced and reduction in crosstalk may be enabled.

Also, in a related art technique, in order to reduce the influence of crosstalk, the compensation circuit 12 has to be formed in as a close position to the for-cable-connection reception side electrodes 9 as possible, but in this embodiment, the influence of crosstalk may be reduced, and therefore, the compensation circuit 12 may be formed in any position on the paddle card 5, thus resulting in increase in the degree of freedom of layout.

Next, another embodiment of the present invention will be described.

Figure 2A:
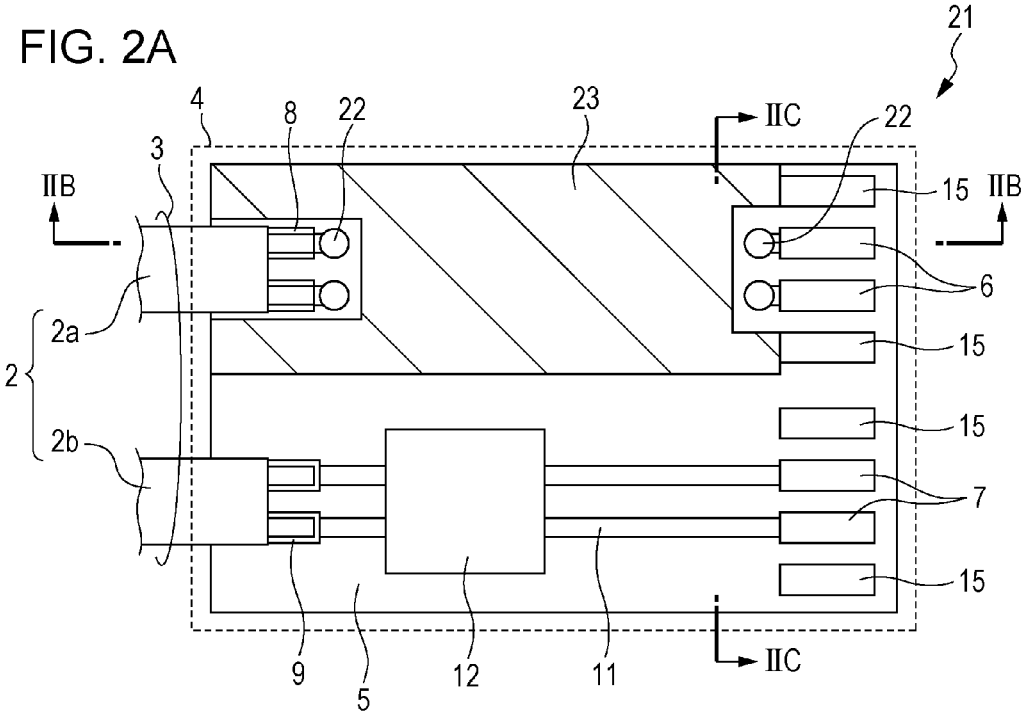
FIGS. 2A to 2C illustrate an active cable according to an embodiment of the present invention.
Figure 2B:
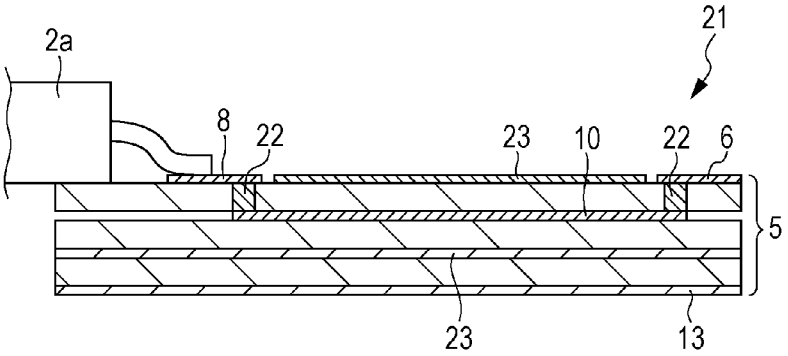
Figure 2C:
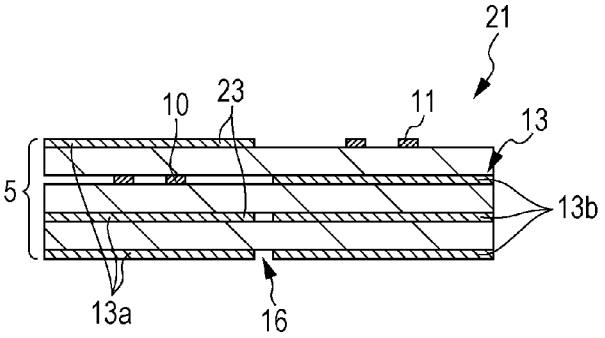

An active cable 21 illustrated in FIGS. 2A to 2C is obtained by forming, in the active cable 1 of FIGS. 1A and 1B, the transmission side transmission channel 10 in an inner layer of the paddle card 5 via a via (an interstitial via hole (IVH)) 22 and forming a ground pattern 23 such that the transmission channel formed in the inner layer is sandwiched by the ground pattern 23 in a thickness direction of the paddle card 5, thereby providing a transmission channel having a strip structure.

The via 22 is formed in each of a position immediately near each for-cable-connection transmission side electrode 8 and a position immediately near each transmission side electrode 6 so as to connect the transmission side transmission channel 10 formed in the inner layer to each of the for-cable-connection transmission side electrodes 8 and to the transmission side electrodes 6.

In this case, the transmission side transmission channel 10 is formed in the second layer of the paddle card 5, but may be formed in another layer. The ground pattern 23 is formed in a layer in which the transmission side transmission channel 10 is formed and an adjacent layer thereto. In this case, the ground pattern 23 is formed in the first layer (the surface layer) and the third layer. Note that the ground pattern 23 is a part of the ground layer 13 and is also the ground layer 13*a* corresponding to the transmission side transmission channel 10.

Also, in this embodiment, substantially the entire transmission side transmission channel 10 is formed into a strip structure, but at least a part of the transmission side transmission channel 10 located at a side closer to the other side than the compensation circuit 12 may be formed to have a strip structure.

Furthermore, in this embodiment, the transmission side transmission channel 10 has a strip structure, but the reception side transmission channel 11 may be formed to have strip structure. However, since there is the compensation circuit 12, in order to form the reception side transmission channel 11 having a strip structure, many vias 22 have to be formed (or only a part thereof located at a side closer to the other side than the compensation circuit 12 may be formed into a strip structure). Therefore, the transmission side transmission channel 10 the entire part of which may be formed into a strip structure is preferably formed into a strip structure.

Note that forming each of the transmission side transmission channel 10 and the reception side transmission channel 11 into a strip structure is another option, but in this case, at least the transmission side transmission channel 10 and the reception side transmission channel 11 have to be formed in different layers. It costs to form the via 22 in each of the transmission channels 10 and 11, and therefore, it is preferable to form only one of the transmission channels 10 and 11 into a strip structure.

The ground pattern 23 formed in the surface layer is formed so as to cover a part surrounding the for-cable-connection transmission side electrodes 8, the transmission side electrodes 6, and the vias 22 formed immediately near the for-cable-connection transmission side electrodes 8 and the transmission side electrodes 6 such that electric field does not leak from the transmission side to the reception side.

In the active cable 21, the transmission channels 10 and 11 are formed in different layers, and the transmission side transmission channel 10 is formed so as to be sandwiched by the ground pattern 23 having a large area in the thickness direction, so that further reduction in influence of crosstalk from the transmission side to the reception side may be enabled.

The present invention is not limited to the above-described embodiments and it is needless to say that modifications may be made thereto without departing from the gist of the present invention.

For example, in the above-described embodiments, a case where a configuration which enables single-channel transmission and reception is has been described, but the present invention is not limited thereto, a configuration which enables transmission and reception using a plurality of channels may be provided.

Figure 3:
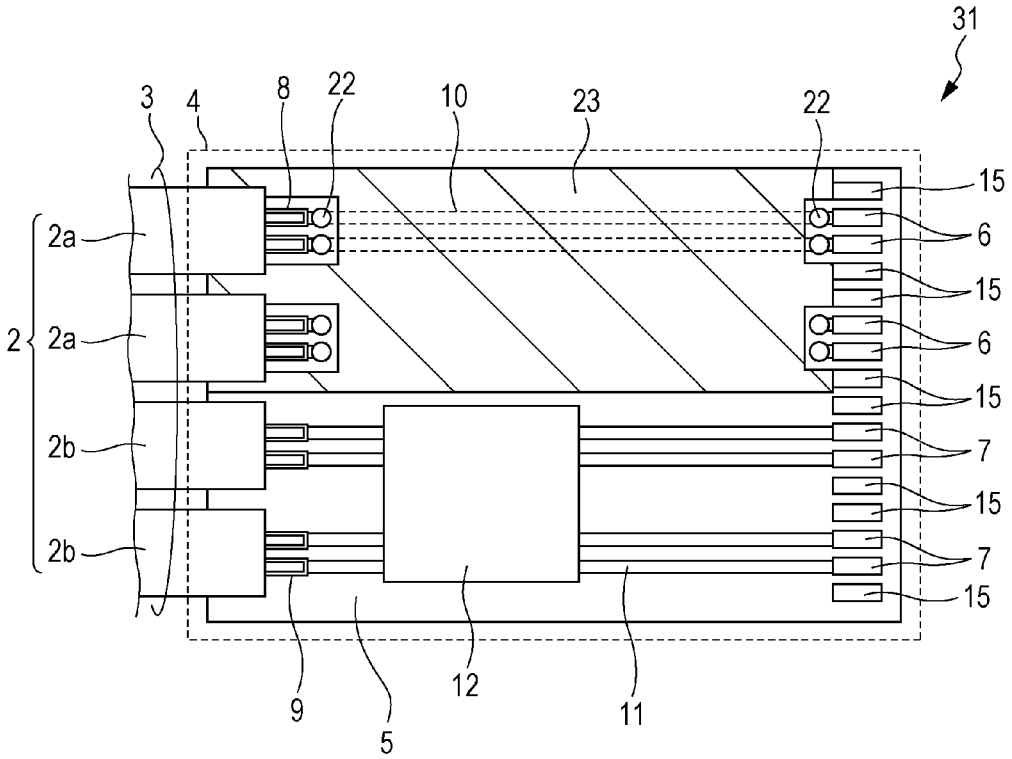
FIG. 3 is a plan view of an active cable according to a modified example of the present invention.
Figure 4A:
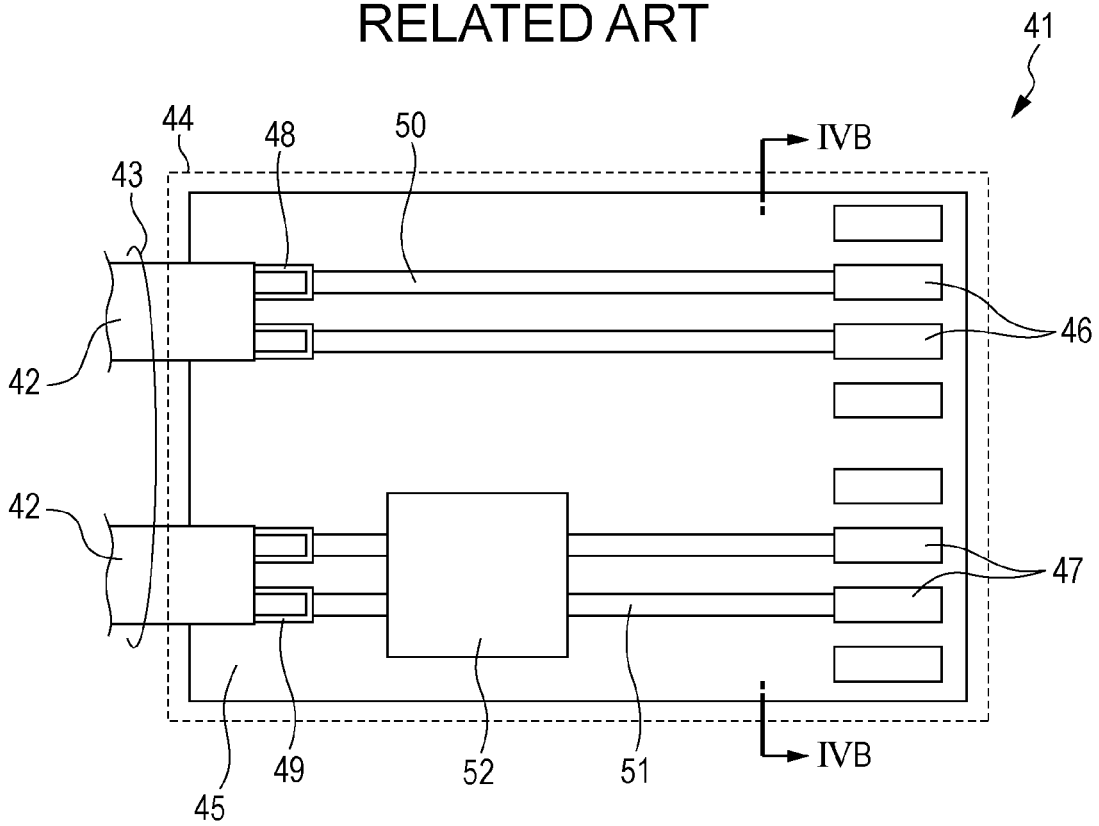
FIG. 4A RELATED ART
FIGS. 4A and 4B illustrate a known active cable.
Figure 4B:
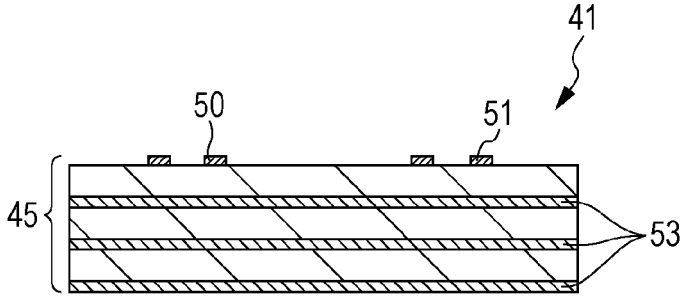
FIG. 4B RELATED ART

For example, as an active cable 31 illustrated in FIG. 3, a configuration in which four differential signal transmission cables 2 are used for each of the transmission side and the reception side, that is, eight differential signal transmission cables 2 in total are used, to enable four-channel transmission and reception may be provided. Two differential signal transmission cables 2*a* for transmission and two differential signal transmission cables 2*b* for reception are connected to the surface of the paddle card 5 and, although not illustrated, two differential signal transmission cables 2*a* for transmission and two differential signal transmission cables 2*b* for reception are connected to a back surface of the paddle card 5. Each electrode forming a card edge connector is disposed, for example, in an arrangement defined by SFF-8436 Specification for QSFP+ 10 Gbs 4× PLUGGABLE TRANSCEIVER Rev 4.4 (SFF-8436).

In order to form the transmission side transmission channel 10 into a strip structure, three layers are needed, and the transmission side transmission channel 10 has to be formed in each of the surface side and the back surface side of the paddle card 5 in the active cable 31. Therefore, a paddle card 5 including six or more layers has to be used.

What is claimed is:

1. An active cable, comprising:

a cable provided with a plurality of differential signal transmission cables;

a connector provided at each of both ends of the cable;

a paddle card including a multilayer substrate which is built in the connector and is configured such that an electrode electrically connected to a connection target device is formed at one end of the paddle card and the differential signal transmission cables are electrically connected to an other end of the paddle card to electrically connect the device and the differential signal transmission cables to one another;

a transmission side transmission channel formed in the paddle card that transmits an electric signal input from the connection target device to the differential signal transmission cables;

a reception side transmission channel formed in the paddle card that transmits an electric signal input from the differential signal transmission cables to the connection target device; and a compensation circuit provided in the reception side transmission channel and configured to compensate an electric signal input from the differential signal transmission cables in accordance with a loss property of the differential signal transmission cables and output the compensated electric signal, wherein a ground pattern sandwiches at least one of:

a part of the transmission side transmission channel located between the other end of the paddle card and a side of the compensation circuit that faces the other end of the paddle card; and a part of the reception side transmission channel located between the other end of the paddle card and the side of the compensation circuit, wherein the ground pattern extends from the other end of the paddle card to the side of the compensation circuit that faces the other end of the paddle card, wherein the ground layer corresponding to the transmission side transmission channel and the ground layer corresponding to the reception side transmission channel are electrically separated, wherein, in a direction of an extension of the ground pattern from the one end of the paddle card to the other end of the paddle card, another part of the transmission side transmission channel, which is located between the one end of the paddle card and another side of the compensation circuit that faces the one end of the paddle card, extends beyond an end edge of the ground pattern, and wherein, in the direction of the extension of the ground pattern, another part of the reception side transmission channel, which is located between the one end of the paddle card and said another side of the compensation circuit, extends beyond the end edge of the ground pattern.

2. The active cable according to claim 1, wherein the transmission side transmission channel and the reception side transmission channel are formed in a surface layer of the paddle card, and wherein the ground pattern is formed so as to sandwich the at least one of the part of the transmission side transmission channel and the part of the reception side transmission channel in a direction parallel to a surface of the paddle card, thereby providing a transmission channel including a coplanar structure.

3. The active cable according to claim 1, wherein one of the at least one of the part of the transmission side transmission channel and the part of the reception side transmission channel is formed in an inner layer of the paddle card via a via, and the ground pattern is formed so as to sandwich the transmission channel formed in the inner layer in a thickness direction of the paddle card, thereby providing a transmission channel including a strip structure.

4. The active cable according to claim 3, wherein the reception side transmission channel is formed in a surface layer of the paddle card and the transmission side transmission channel is formed in an inner layer of the paddle card, thereby providing a strip structure.

5. The active cable according to claim 1, wherein the paddle card comprises a ground layer which is divided into a first ground layer corresponding to the transmission side transmission channel and a second ground layer corresponding to the reception side transmission channel.

6. The active cable according to claim 1, wherein the ground pattern sandwiches the part of the transmission side transmission channel without sandwiching another part of the transmission side transmission channel located between the one end of the paddle card and another side of the compensation circuit that faces the one end of the paddle card.

7. The active cable according to claim 1, wherein the ground pattern sandwiches the part of the reception side transmission channel without sandwiching another part of the reception side transmission channel located between the one end of the paddle card and another side of the compensation circuit that faces the one end of the paddle card.

8. The active cable according to claim 1, wherein the ground pattern sandwiches the part of the transmission side transmission channel without sandwiching another part of the transmission side transmission channel located between the one end of the paddle card and another side of the compensation circuit that faces the one end of the paddle card, and wherein the ground pattern sandwiches the part of the reception side transmission channel without sandwiching another part of the reception side transmission channel located between the one end of the paddle card and said another side of the compensation circuit.

9. The active cable according to claim 1, wherein the one end of the paddle card and the other end of the paddle card are located on opposing sides of the paddle card.

10. The active cable according to claim 1, wherein, in the direction of the extension of the ground pattern from the one end of the paddle card to the other end of the paddle card, another part of the reception side transmission channel, which is located between the one end of the paddle card and said another side of the compensation circuit that faces the one end of the paddle card, extends beyond the end edge of the ground pattern.

* * * * *